US007549868B1

(12) United States Patent
Ho

(10) Patent No.: US 7,549,868 B1
(45) Date of Patent: Jun. 23, 2009

(54) COAXIAL CABLE CONNECTOR

(75) Inventor: Hsin-Tsung Ho, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/135,488

(22) Filed: Jun. 9, 2008

(51) Int. Cl.
*H01R 12/00* (2006.01)

(52) U.S. Cl. ..... 439/63; 439/582

(58) Field of Classification Search ..... 439/578–585, 439/63, 394, 607, 610
See application file for complete search history.

(56) References Cited

U.S. PATENT DOCUMENTS 5,879,190 A 3/1999 Maruyama et al.
6,916,201 B1 * 7/2005 Chu ..... 439/582
6,997,745 B2 * 2/2006 Ikeda ..... 439/582
7,025,598 B2 * 4/2006 Ikeda ..... 439/63
7,351,067 B2 * 4/2008 Chen et al. ..... 439/63

* cited by examiner

*Primary Examiner*—Khiem Nguyen

(57) ABSTRACT

A coaxial cable connector includes an insulating housing, a terminal received in the insulating housing and a shell surrounding the insulating housing. The insulating housing has an extending portion and an erect flat portion extending from the extending portion. The extending portion has a bottom wall and two sidewalls. The sidewalls respectively protrude toward each other to form a protruding lump. Two opposite sides of the erect flat portion respectively protrude outward to form a wedge portion. When the flat portion is bent to cover the terminal, the wedge portions are held by the protruding lumps to assure the terminal be held in the insulating housing tightly.

6 Claims, 6 Drawing Sheets

COAXIAL CABLE CONNECTOR

BACKGROUND OF THE INVENTION

1. Field of the Invention

The present invention relates to a connector, and more particularly to a coaxial cable connector.

2. The Related Art

A conventional coaxial cable connector disclosed in U.S. Pat. No. 5,879,190 is generally used for connecting a coaxial cable with an electronic device for transmitting radio-frequency (RF) signals. The coaxial cable connector includes a metallic housing, an insulating bushing mounted in the metallic housing and a connecting terminal constructed to allow insertion of a center conductor portion of the coaxial cable. The insulating bushing defines a central hole therein for holding the connecting terminal and a cover for covering the central hole.

However, the insulating bushing has no fixtures to locate the cover and therefore, the connecting terminal is held in the insulating bushing unstably. When the coaxial cable connector mates with a complementary connector, the connecting terminal is pushed upward by the complementary connector so that the connecting terminal pushes the cover upward. Therefore the coaxial cable connector works in an unstable status.

SUMMARY OF THE INVENTION

An object of the present invention is to provide a coaxial cable connector including an insulating housing, a terminal received in the insulating housing and a shell retaining the insulating housing therein. The insulating housing includes an extending portion, and an erect flat portion extending from the extending portion. The extending portion has a bottom wall and two sidewalls. The sidewalls respectively protrude toward each other to form a protruding lump. Two opposite sides of the erect flat portion respectively protrude outward to form a wedge portion. When the flat portion is bent to cover the terminal, the protruding lumps holds the wedge portion to secure the terminal in the insulating housing tightly.

As described above, by means of the protruding lumps of the extending portion wedging the wedge portions of the flat portion, the terminal is covered under the flat portion tightly, which avoids a complementary connector pushing the terminal upward when the coaxial cable connector mates with the complementary connector, so that the coaxial cable works in a stable status.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
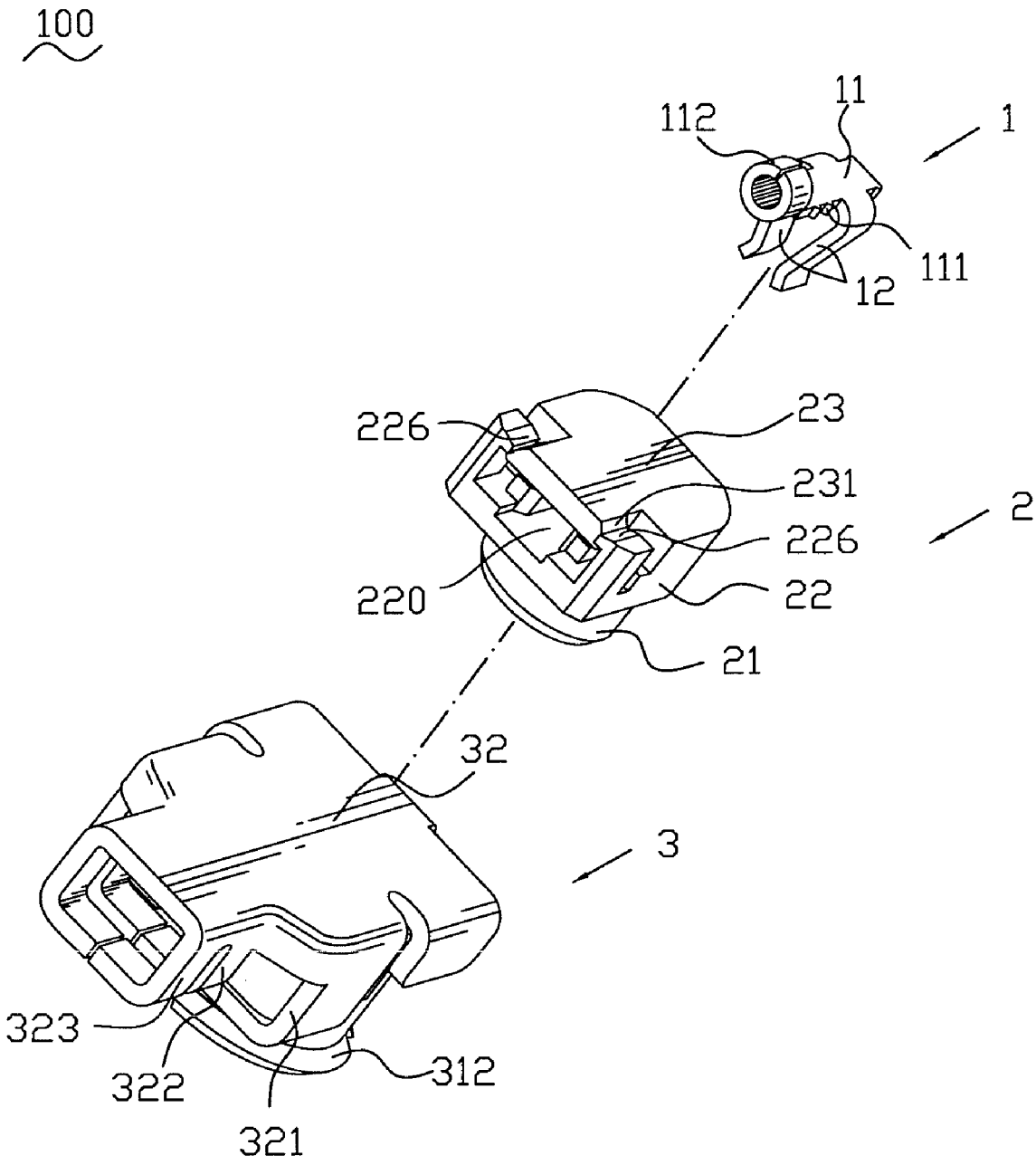
FIG. 1 is an exploded perspective view of a coaxial cable connector in accordance with the present invention.

With reference to FIG. 1, a coaxial cable connector 100 includes a terminal 1, an insulating housing 2 and a shell 3. The terminal 1 has a substantially rectangular base portion 11 and a pair of mating portions 12 extending downwardly from two opposite sides of the base portion 11 with both free ends of each mating portion 12 projecting toward each other for mating with a complementary connector (not shown). A plurality of protruding thorns 111 protrudes outwardly from the two opposite sides of the base portion 11. Two opposite sides of a tip end of the base portion 11 extend outward respectively to form a substantially rectangular retaining portion 112. When a coaxial cable 200 (as shown in FIG. 4) contacts with the terminal 1, the retaining portion 112 is curled up to retain the coaxial cable 200 therein.

Figure 2:
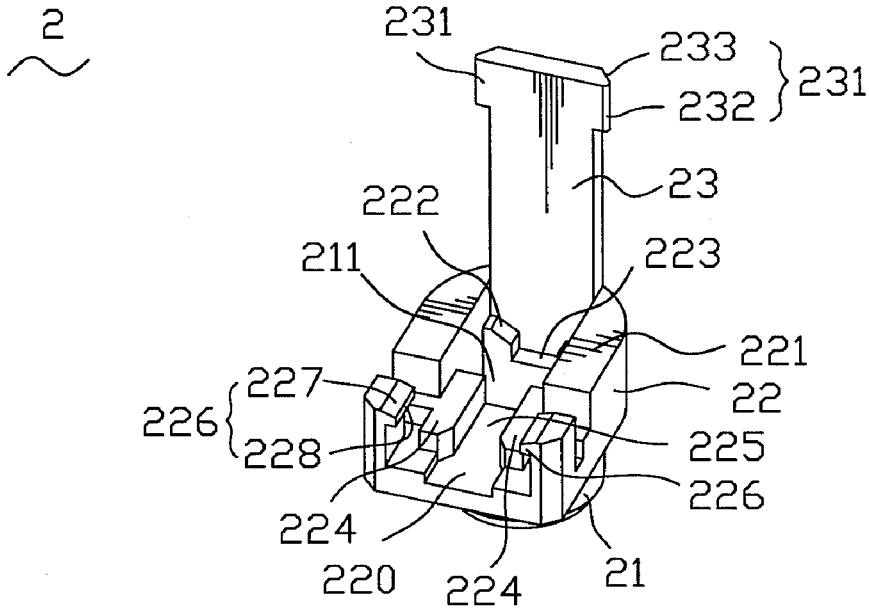
FIG. 2 is a perspective view of an insulating housing of the coaxial cable connector shown in FIG. 1.

Referring to FIG. 1 and FIG. 2 again, the insulating housing 2 has a tubular portion 21, an extending portion 22 protruding upward from the top of the tubular portion 21 and an erect flat portion 23 extending upward from a rear portion of the extending portion 22. The extending portion 22 has a bottom wall 220, two sidewalls 221 extending upward from two opposite sides of the bottom wall 220 and attached to opposite sides of the flat portion 23, so that the bottom wall 220, the two sidewalls 221 and the flat portion 23 define collectively a receiving space therebetween. A rear portion of the bottom wall 220 protrudes upward to form an erect portion 222 in front of the flat portion 23. The erect portion 222 defines a locating cavity 223 at the middle portion thereof. Two supporting portions 224 protrude upward from the opposite sides of the bottom wall 220 and are received in the receiving space described above. The space defined between the two supporting portions 224 is defined as a receiving recess 225. A substantially rectangular passageway 211 is axially defined through the bottom wall 220 and the tubular portion 21 and between the erect portion 222 and the two supporting portions 224. So the receiving recess 225 communicates with the passageway 211. Each of the two sidewalls 221 protrudes toward the inside of the receiving space at a top portion thereof to form a protruding lump 226 having an abutment surface 228 facing the receiving space and parallel to the sidewall 221, and a guide surface 227 angled with respect to the abutment surface 228. Two opposite sides of a free end of the flat portion 23 respectively protrude outward to form a wedge portion 231. Each of the wedge portions 231 has an inclined side surface 233 and a sharp corner 232 which is smoothly cambered connecting the inclined side surface 233 and a bottom surface of the wedge portion 231 together.

Figure 3:
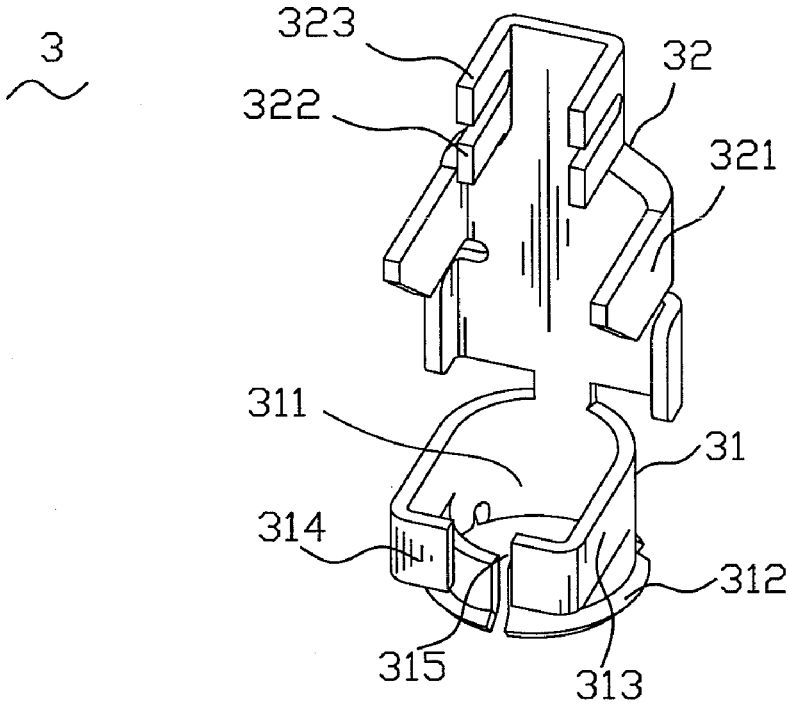
FIG. 3 is a perspective view of a shell of the coaxial cable connector shown in FIG. 1.

Referring to FIG. 1 and FIG. 3, the shell 3 has a trunk portion 31 and a fastener portion 32 extending upward from the rear portion of the trunk portion 31. The trunk portion 31 defines an accommodating cavity 311 passing therethrough. The bottom of the trunk portion 31 extends downward and outward slightly to form a pedestal 312. The trunk portion 31 has a pair of substantially rectangular arms 313 extending forward on opposite sides of the upper portion thereof. A free end of each arm 313 is inwardly bent to form a tab 314, and a gap 315 is formed between the two tabs 314. Two opposite edges of the fastener portion 32 respectively extend forward to form a pair of first engagement tongue portions 321, a pair of second engagement tongue portions 322 and a pair of third engagement tongue portions 323.

Figure 4:
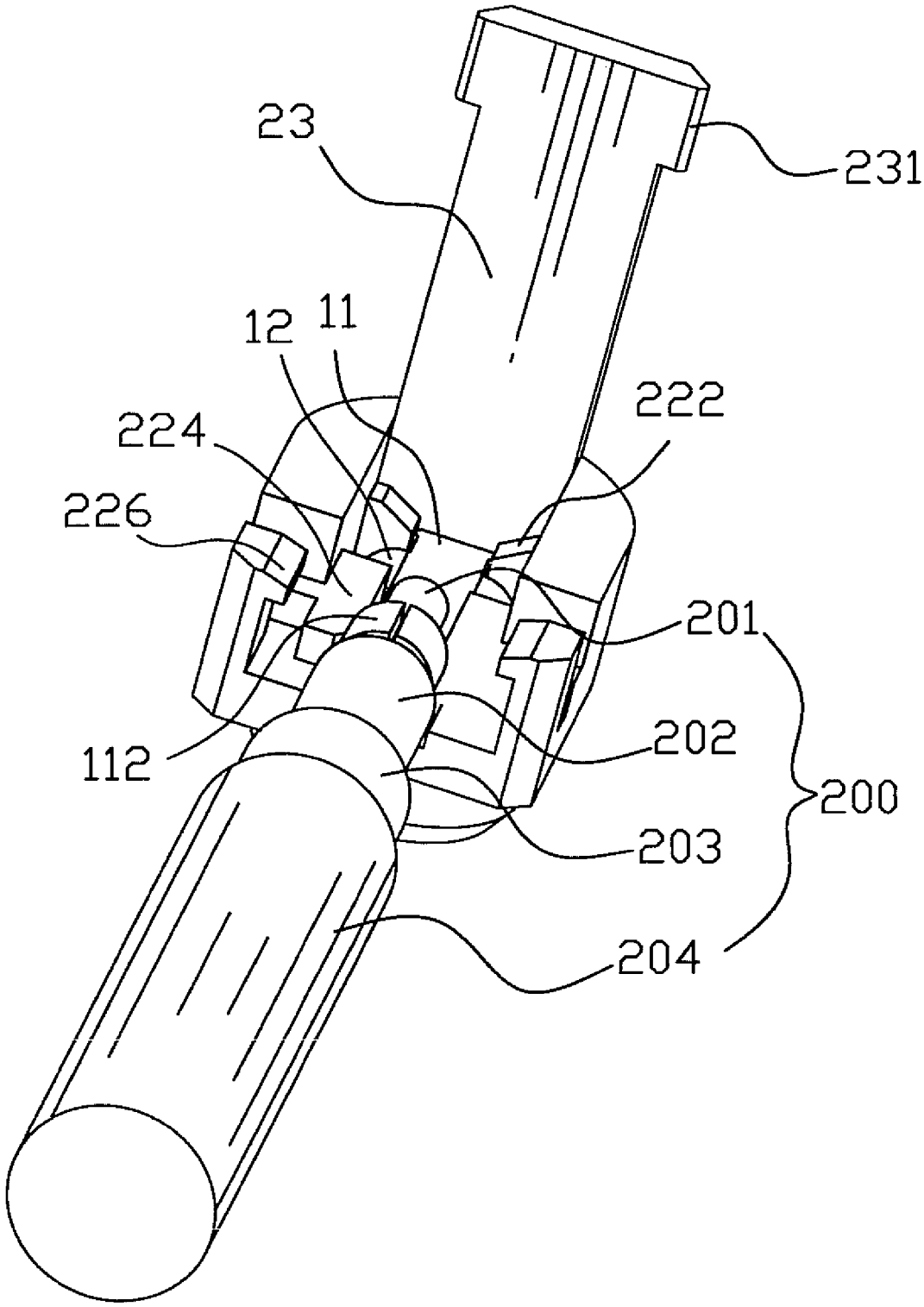
FIG. 4 is an assembled perspective view of a coaxial cable, a terminal of the coaxial cable connector and the insulating housing shown in FIG. 1.
Figure 5:
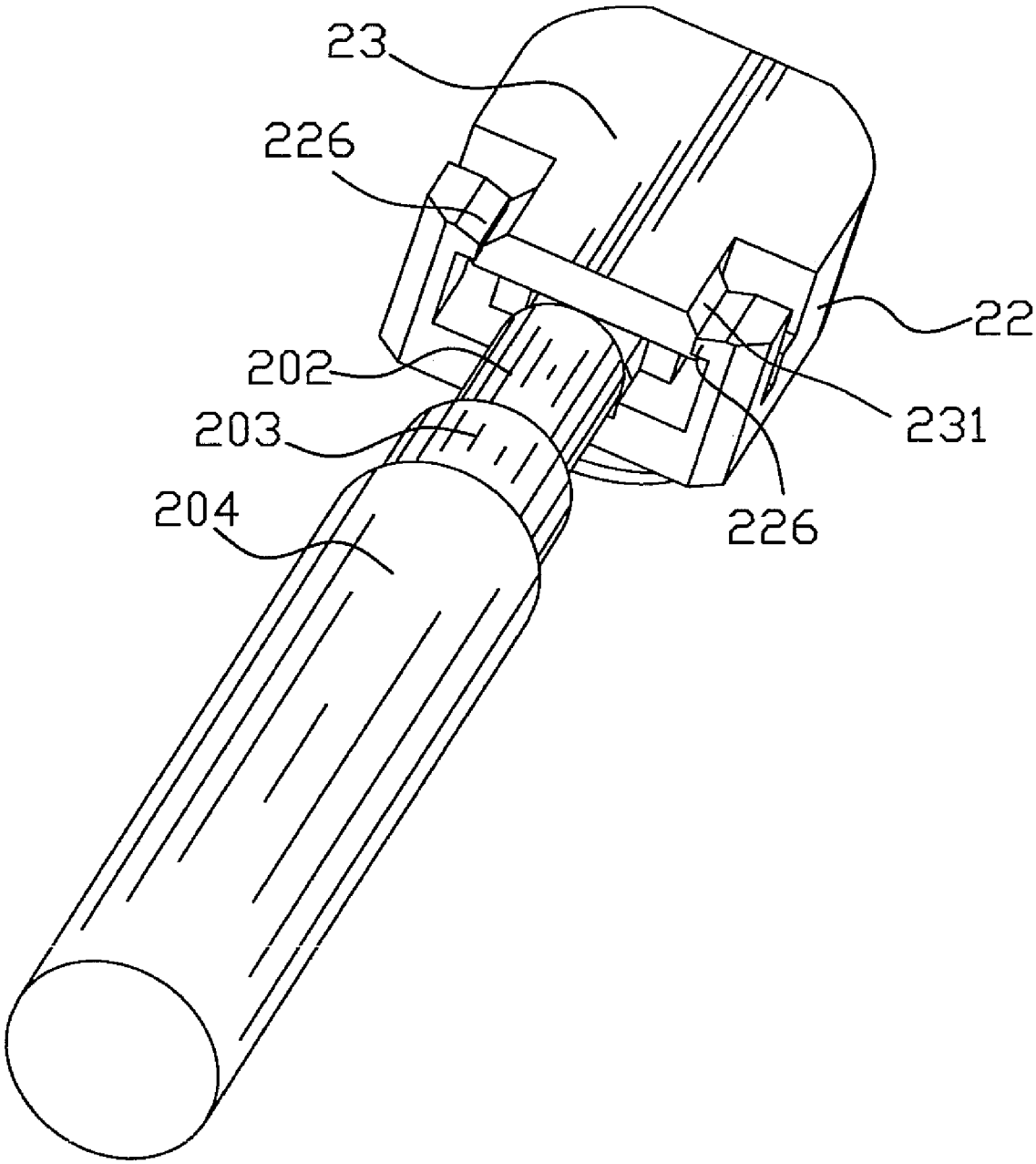
FIG. 5 illustrates a flat portion of the insulating housing bent to be locked in the insulating housing shown in FIG. 4.
Figure 6:
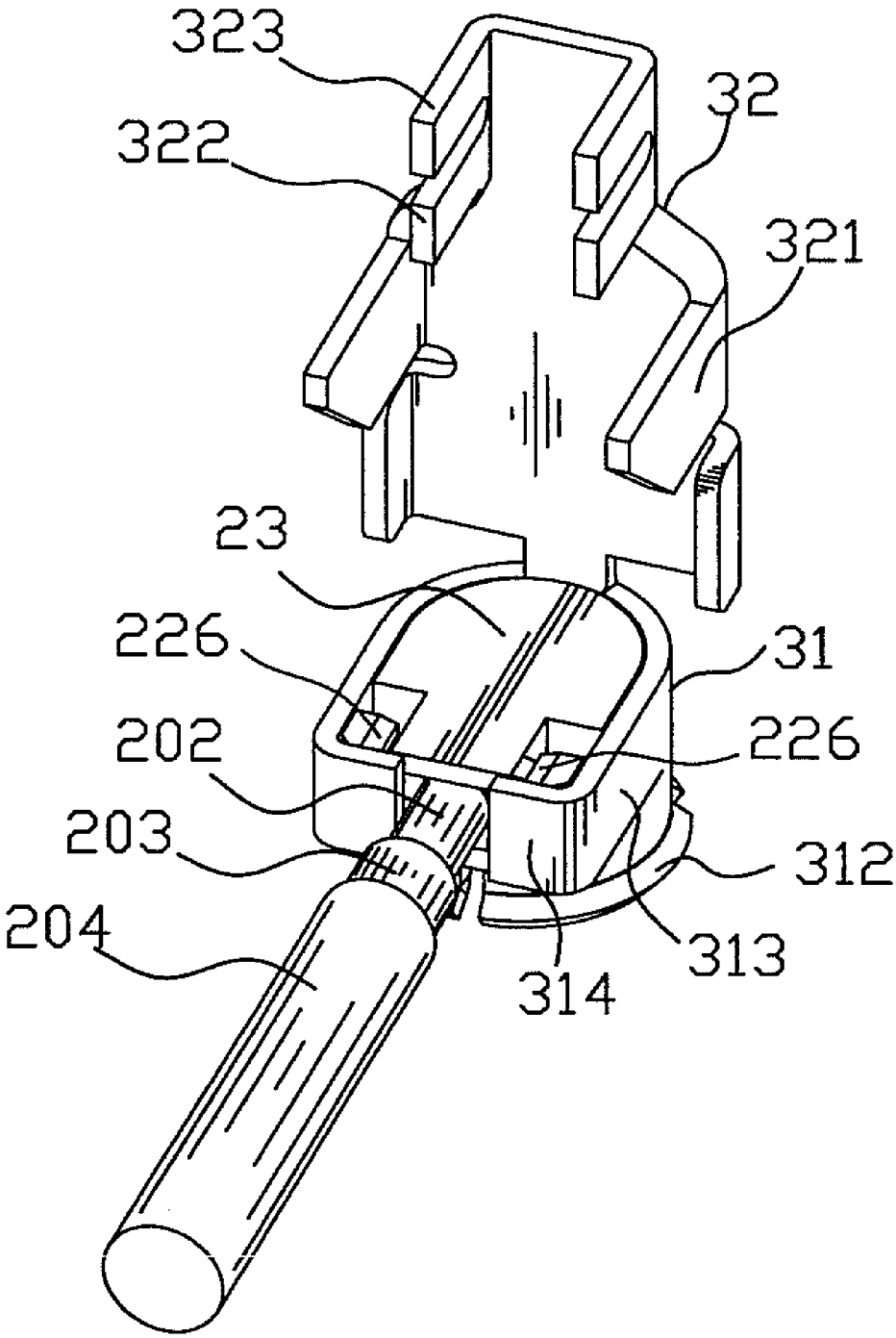
FIG. 6 illustrates a combination of the coaxial cable, the terminal and the insulating housing assembled in the shell.
Figure 7:
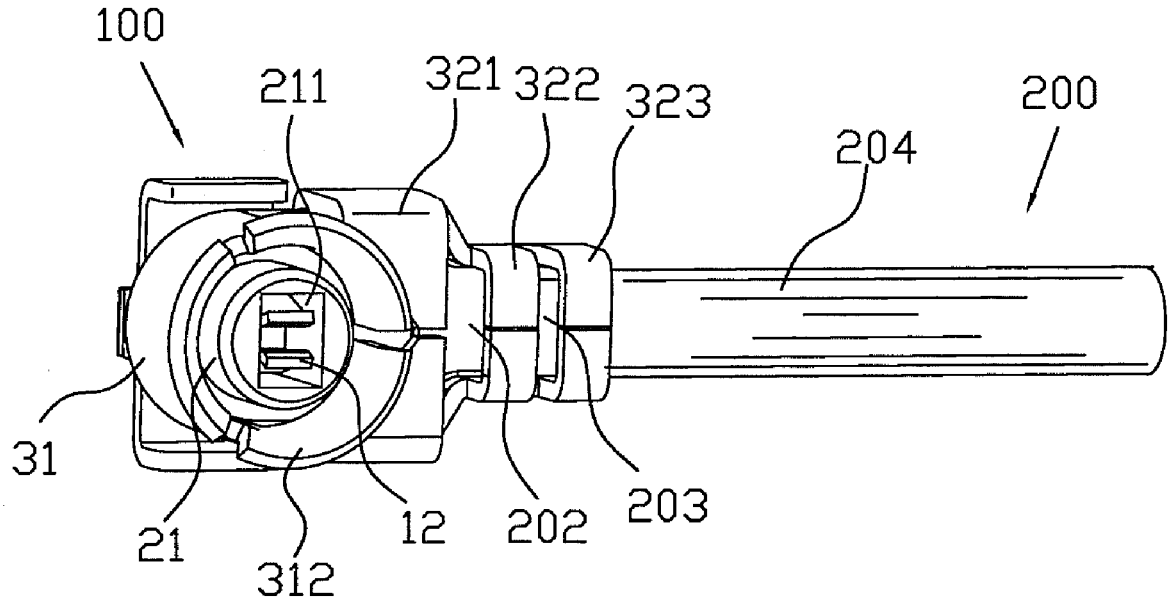
FIG. 7 is a perspective view of the coaxial cable connector engaging with the coaxial cable.

Referring to FIG. 4, the coaxial cable 200 includes an inner conductor 201, a braiding layer 203, an inner insulator 202 separating the inner conductor 201 from the braiding layer 203, and an outer insulator 204 surrounding the braiding layer 203.

Reference is made to FIG. 1 to FIG. 7 in which how the coaxial cable connector 100 is assembled and used with the coaxial cable 200 is described as follows.

Firstly, the inner conductor 201 of the coaxial cable 200 is placed on the base portion 11 of the terminal 1 and then the retaining portion 112 of the terminal 1 is curled up by machine to form a cylindrical construction that retains the inner conductor 201, thus makes the inner conductor 201 contact electrically and stably the terminal 1.

Secondly, the terminal 1 with the coaxial cable 200 assembled thereto is inserted into the insulating housing 2 with the mating portions 12 received through the passageway 211, while the base portion 11 received in both the locating cavity 223 and the receiving recess 225. Then the flat portion 23 is bent toward the extending portion 22. In this case, the protruding lumps 226 are widen outwardly because of the great pushing force generated by forceful contact of the wedge portions 231 with the lumps 226. The shape corners 232 of the wedge portions 231 slide against the guide surfaces 227, and then slip downwardly along and pass over the abutment surfaces 228 of the protruding lumps 226. Because of resilience of the protruding lumps 226, the protruding lumps 226 squeeze the inclined side surfaces 233 of the wedge portions 231 to hold the wedge portions 231 firmly.

Finally, the insulating housing 2 is inserted into the accommodating cavity 311 of the shell 3 with the front end of the sidewalls 221 of the extending portion 22 abutting against the inner side of the tabs 314 of the trunk portion 31. The inner insulator 202 of the coaxial cable 200 is located in the gap 315 and clipped via the two tabs 314. Then the fastener portion 32 of the shell 3 is bent toward the trunk portion 31 until the fastener portion 32 completely abuts the flat portion 23 of the insulating housing 2. Next, the first engagement tongue portions 321, the second engagement tongue portions 322 and the third engagement tongue portions 323 are crimped respectively to retain the tabs 314 of the trunk portion 31, the braiding layer 203 and the outer insulator 204 of the coaxial cable 200 therein respectively. Therefore, the coaxial cable 200 is securely connected with the coaxial cable connector 100.

As described above, by means of the protruding portions 226 of the extending portion 22 wedging the wedge portions 231 of the flat portion 23, the terminal 1 is covered under the flat portion 23 tightly, which avoids a complementary connector pushing the terminal 1 upward when the coaxial cable connector mates with the complementary connector, so that the coaxial cable works in a stable status.

What is claimed is:

1. A coaxial cable connector, comprising:

an insulating housing having an extending portion and an erect flat portion extending from the extending portion, the extending portion having a bottom wall, two sidewalls extending upward from two opposite sides of the bottom wall, the bottom wall, the two sidewalls and the erect flat portion collectively defining a receiving space therebetween, a passageway which passes through the bottom wall of the extending portion and communicates the receiving space being defined in the insulating housing, each of the two sidewalls protruding toward the inside of the receiving space to form a protruding lump, two opposite sides of the erect flat portion respectively protruding outward to form a wedge portion held by the protruding lumps to secure the erect flat portion therein when the erect flat portion being bent to cover the receiving space; and a terminal placed in the receiving space with a mating portion received in the passageway of the insulating housing.

2. The coaxial cable connector as clamed in claim 1, wherein the protruding lump has an abutment surface facing the receiving space and a guide surface angled with respect to the abutment face, the wedge portion of the erect flat portion having an inclined side surface and a sharp corner which is smoothly cambered to connect the inclined side surface and a bottom surface of the wedge together, the sharp corner sliding along the guide surface and then slipping downward along the abutment surface, thus the protruding lump pressing on the inclined side surface to retain the wedge portion firmly when the erect flat portion being bent to cover the receiving space.

3. The coaxial cable connector as claimed in claim 1, further comprising a shell to hold the insulating housing therein, the shell having a fastener portion pressed on the erect flat portion to fasten the erect flat portion therebetween.

4. The coaxial cable connector as clamed in claim 3, wherein the fastener portion defines at least a pair of engagement tongue portions extending from both lateral sides thereof to hold the erect flat portion firmly when the engagement tongue portions are bent toward each other.

5. The coaxial cable connector as claimed in claim 3, wherein the shell has a trunk portion upon which the fastener portion is extended.

6. The coaxial cable connector as claimed in claim 5, wherein the trunk portion defines an accommodating cavity which passes therethrough for receiving the insulating housing therein, the trunk portion further defining a pair of arms extending forwardly on opposite sides of the upper portion thereof with a free end of each arm being inwardly bent to form a tab, and a gap being formed between the two tabs, the insulating housing being also held by the tabs and arms respectively.

* * * * *